United States Patent [19]

Glynn

[11] 4,370,912

[45] Feb. 1, 1983

[54] SOUND PRODUCING INSTRUMENT

[76] Inventor: Christopher Glynn, 22 Brookwood Rd., Artane, Dublin, Ireland

[21] Appl. No.: 244,113

[22] Filed: Mar. 16, 1981

[51] Int. Cl.[3] ..... G10D 13/06

[52] U.S. Cl. ..... 84/418; D17/22

[58] Field of Search ..... D17/22; 46/191, 193; 84/402, 418, 411; 272/14

[56] References Cited

U.S. PATENT DOCUMENTS

| | | | |
|---|---|---|---|
| 3,704,340 | 11/1972 | Hall | 84/170 |
| 4,253,657 | 3/1981 | Rozzelle | 272/14 |
| 4,269,105 | 5/1981 | Salmon | 84/402 R |

FOREIGN PATENT DOCUMENTS

| | | |
|---|---|---|
| 205444 | 10/1923 | United Kingdom . |
| 402213 | 11/1933 | United Kingdom . |
| 578539 | 7/1946 | United Kingdom . |
| 765869 | 1/1957 | United Kingdom . |
| 842602 | 7/1960 | United Kingdom . |
| 956143 | 8/1960 | United Kingdom . |
| 1022388 | 3/1966 | United Kingdom . |
| 1113780 | 4/1967 | United Kingdom . |
| 1471146 | 4/1977 | United Kingdom . |

*Primary Examiner*—Lawrence R. Franklin
*Attorney, Agent, or Firm*—Irvin A. Lavine

[57] ABSTRACT

A sound producing instrument comprises a staff having a group of pins projecting from each end of the staff, and a plurality of cupped discs mounted on each pin. A rod having a toothed surface may be used in combination with the instrument. The staff may be moved up and down, shaken from side to side, and/or stroked across its central portion by the toothed rod, thereby producing a rythmic sound.

13 Claims, 3 Drawing Figures

SOUND PRODUCING INSTRUMENT

FIELD OF THE INVENTION

The present invention relates to sound producing instruments.

SUMMARY OF THE INVENTION

The invention provides a sound producing instrument which comprises:

(a) a staff;

(b) a plurality of pins supported by the staff adjacent at least one end thereof; and (c) a plurality of sound producing elements supported on each pin;

whereby when the staff is shaken, struck or caused to vibrate, the instrument produces sound.

Advantageously, at least some of the sound producing elements are cupped discs, each of which has an aperture in the centre thereof through which passes the disc supporting pin, each of the discs being freely moveable along the supporting pin.

Advantageously a group of pins are supported by the staff adjacent each end thereof thereby defining a central portion of the staff between the group of pins. The instrument may comprise three detachable inter-connecting parts, an upper and lower part each having sound producing elements and a central part.

The invention also provides, in combination, a sound producing instrument as above, and a rod for use therewith, which rod is cylindrical and has a series of transverse grooves which serve to define a plurality of teeth, so that when used to stroke the instrument, successive teeth contact the instrument imparting to it a succession of impacts.

BRIEF DESCRIPTION OF THE DRAWINGS

The invention will now be described more particularly with reference to the accompanying drawings. In the drawings.

DESCRIPTION OF THE PREFERRED EMBODIMENT

Figure 1:
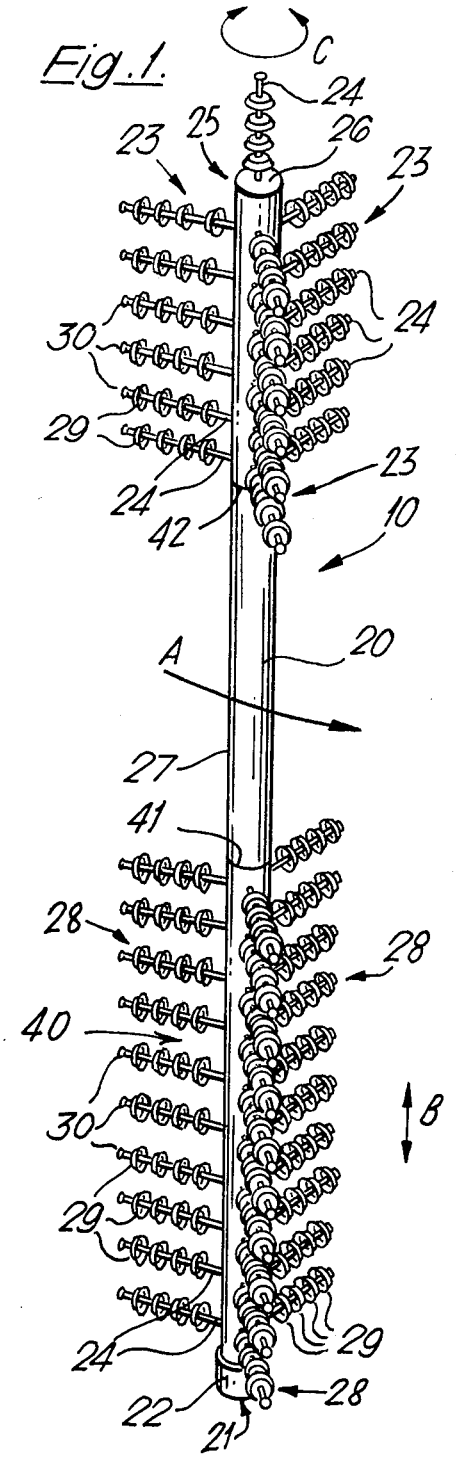
FIG. 1 is a perspective view of an instrument.

Referring firstly to FIG. 1 the instrument 10 comprises a wooden staff 20 about four feet (4') in length and one and a half inches (1½") in diameter. A protective rubber covering 22 is provided at one end 21 of staff 20. In use staff 20 is held erect with end 21 lowermost, and end 21 will hereinafter be referred to as "lower end 21".

The staff 20 comprises an upper part 25, a lower part 40 and a central part 27.

Three series 23 of pins 24 extend from the upper part 25 of the length of staff 20. Each series 23 comprises six parallel pins 24 spaced apart at equal intervals, located one above the other in the erect position of staff 20, and each pin extending radially from the staff. The series 23 of pins 24 are disposed at equal intervals about staff 20, that is at angles of 120° to one another. Pins 24 are about four inches (4") in length. The pins 24 in each series 23 are spaced apart a distance of about two inches (2"), so that the series 23 extend a distance of approximately twelve inches (12") from the upper end 26 of staff 20 towards the central part 27 of the staff 20.

Three similar series 28 of pins 24, each series 28 comprising ten pins 24, are located at the lower part 40 of the staff 20. The pins 24 are again spaced apart by about two inches (2"), so that the series 28 extend a distance of about eighteen inches (18") from lower end 21 of staff 20 towards the central part 27 of the staff 20.

The central part 27 of the staff 20, which is about sixteen to eighteen inches (16"–18") in length, has no pins 24.

Finally, one pin 24 extends from the upper end 26 of staff 20 co-axial with staff 20.

Located on each branch 24 are cupped metallic discs 29. Discs 29 are slidably mounted on pins 24, so that when instrument 10 is shaken or moves discs 29 on each pin 24 produce a sound by contacting one another or by contacting the pin 24.

Figure 2:
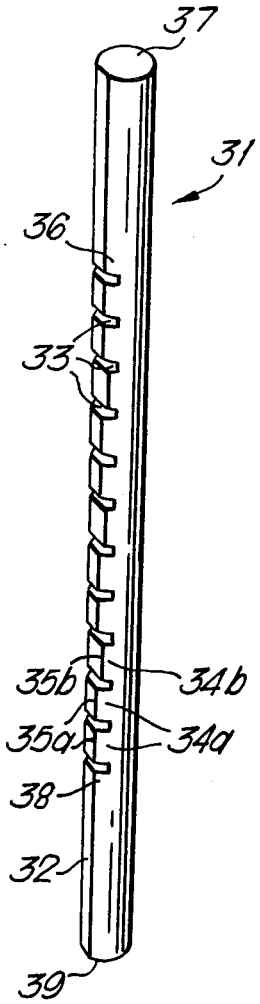
FIG. 2 is a perspective view of a rod.

Referring now to FIG. 2, rod 31 is formed from a substantially cylindrical piece of wood, for example beech or blackthorn. Rod 1 has a length of approximately twenty one inches (21"). It is fashioned so that one flattened surface or surface of reduced curvature 32 extends along its length. A series of equally spaced transverse grooves 33 are provided in flattened surface 32 at intervals of about one inch (1"). The series extends for about twelve inches (12"), leaving a distance of about five inches (5") between the ends 36 of the series of grooves 33 and the end 37 of rod 31 and leaving a distance of about four inches (4") between the other end 38 of the series of grooves 33 and the other end 39 of rod 31. Grooves 33 define between them a series of teeth **34*a* and 34*b*. Teeth 34*a* have upper surfaces 35*a* coplanar with the flattened surface 32 of rod 31. Every third tooth 34*b* is, however, recessed with respect to flat surface 32. The entire surface of rod 31** is polished so that it is smooth.

Referring back to FIG. 1, the use of rod 31 in playing instrument 10 will now be described. The player or musician (not shown) adopts a standing position to play instrument 10. The player holds instrument 10 erect, with rubber covered end 21 contacting the ground, by gripping staff 20 with one hand (the right hand, say) just below upper series 23 of pins 24. In his left hand the player holds rod 31, gripping it near end 37. The player holds rod 31 out from him and draws it inwardly towards him and downwardly, as indicated by arrow A in FIG. 1, so that flattened surface 32 of rod 31 is drawn across central portion 27 of staff 20. As the flattened, indented surface 32 of rod 31 is drawn across instrument 10, instrument 10 suffers a succession of impacts of periodically varying intensity and separation.

Instrument 10 may of course be struck a series of blows of periodically varying intensity and separation using any rod or stick and delivering each blow individually. However, the advantage of a rod according to the invention is that it enables these blows to be produced at a rate which might not be possible if each blow had to be delivered individually. For example one stroke of a rod having twelve indentations may produce twelve impacts or blows, one for each indentation, whereas twelve separate blows would be needed if a simple rod or stick were used. In addition, rods according to the invention enable periodic variations in the intensity and separation of blows to be delivered with consistent accuracy; all that is necessary is that the player deliver each stroke at the same speed and hold the rod with consistent firmness.

It is to be understood that the beats produced by rod 31 may not, and indeed usually are not, the only beats which are produced when rod 31 and instrument 10 are used together. In addition to being stroked by rod 31, instrument 10 may be "bounced" up and down vertically as indicated by arrow B, and may be made to perform oscillations about its vertical axis, as indicated by arrow C. Thus rods according to the invention enable closely separated beats of varying frequency to be superimposed on other beats.

The operation of rod 31 will now be explained. For simplicity, each stroke of rod 31 against instrument 10 may be considered as a movement of instrument 10 along flattened surface 32 of rod 31, and reference may be made to FIG. 2 which illustrates flattened surface 32. As instrument 10 is drawn along rod 31 from end 37 to end 39, instrument 10 slides along flattened surface 32 and suffers a slight impact as it encounters the forward edge of the first tooth, tooth 34*a*, that is as it encounters the first of the grooves 33. Grooves 33 are narrow enough that instrument 10 does not enter or catch in grooves 33. Instrument 10 then slides along upper surface 35*a* of tooth 34*a* and encounters the forward edge of the second tooth 34*a*, that is the instrument 10 encounters the second groove 33 where it suffers a second slight impact. Instrument 10 then slides along the upper surface 35*a* of the second tooth 34*a* and "falls" down to a point probably at about the middle of the upper surface 35*b* of the third tooth 34*b*, which third tooth 34*b* is recessed with respect to the first two teeth 34*a*, thus undergoing a third impact, somewhat larger than the previous two impacts. The instrument 10 then slides along upper surface 35*b* of the third tooth 34*b* where it encounters the forward edge of the fourth tooth 34*a*, thus completing one period comprising two relatively smaller impacts followed by a larger impact, and the time between the second and third impacts being perhaps one and a half times that between the first and second impacts.

To facilitate transport, the three parts 25, 40, and 27 are detachable from one another at 41 and 42, being interconnected by any suitable means.

This also facilitates manufacture of instruments of different length for players of different height. Central parts 27 of different length may be produced for fitting to end parts of a single size.

A shorter version of the instrument or a part of a disassembled instrument may be played resting on the player's knee instead of being held erect.

Referring to FIG. 1, the discs 29 are held on each pin 24 by means of a "head" 30 at the outer end of each pin 24. Each pin 24 may however be provided with a force fitted moveable nylon collar (not shown) which can be moved along the pin. Discs 29 can then be locked against staff 20 when instrument 10 is being transported. The effective length of the pin 24 may be varied by varying the position of the collar on the pin 24, thereby enabling the sound produced to be varied.

Figure 3:
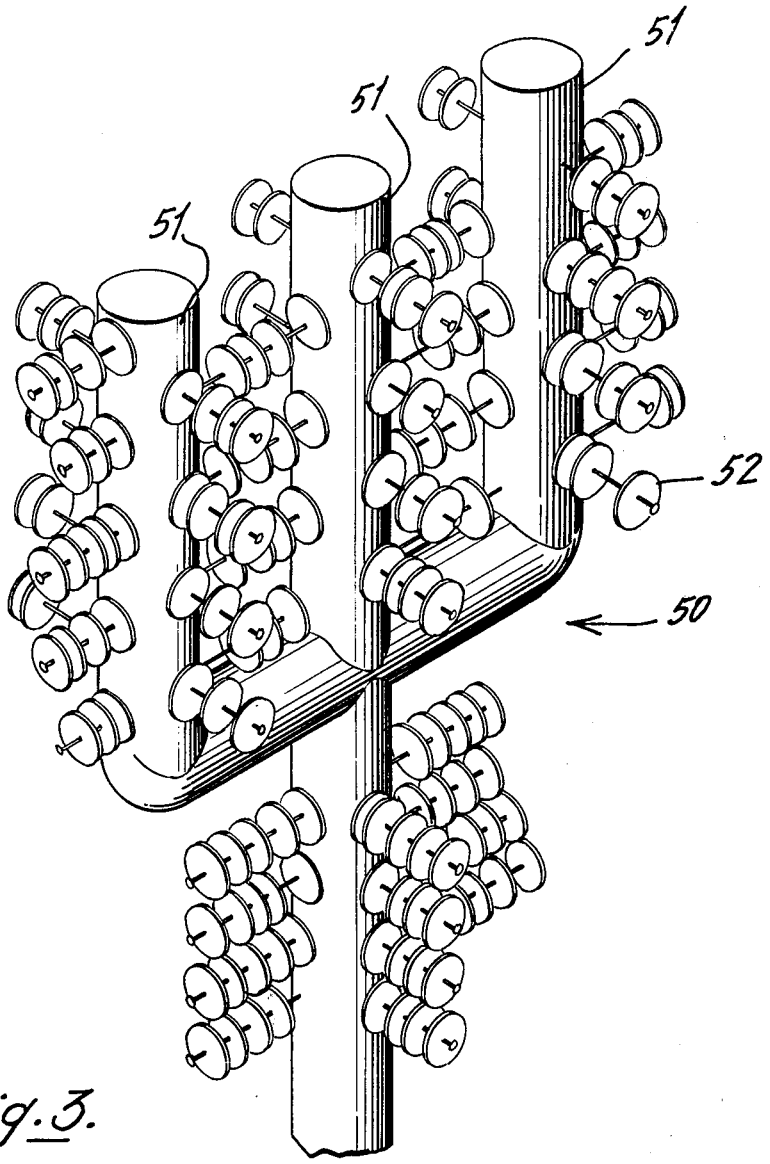
FIG. 3 is a perspective view of a portion of a modified form of instrument.

FIG. 3 shows the upper part of a modified form of instrument which is branched or forked to provide support for additional sound producing elements. Instrument 50 has three branches 51, each supporting sound producing elements 52.

I claim:

1. In combination, (1) a musical percussion instrument comprising:

(a) a staff having a central portion, an upper end portion, and a lower end portion, (b) a plurality of pins supported at the upper end portion of the staff, and (c) a plurality of sound producing elements supported on each pin, and (2) a toothed rod for drawing across said central portion of the staff so that successive teeth on the rod impart to the staff a succession of impacts;

the instrument being capable of producing three different beats, each beat being independent of each other beat, the first beat being produced by striking the lower end portion of the staff rythmically against the ground whilst the staff is held generally vertically, the second beat being produced by oscillating the upper end portion of the staff about its vertical axis, and the third beat being produced by drawing the toothed rod across the central portion of the staff, the instrument also being capable of producing any combination of two said beats simultaneously, or all three beats simultaneously.

2. The combination of claim 1 in which at least some of the sound producing elements are cupped discs, each of which has an aperture in the centre thereof through which passes the disc supporting pin, each of the discs being freely moveable along the supporting pin.

3. The combination of claims 1 or 2, in which a group of pins are supported by the staff adjacent each end thereof thereby defining a central portion of the staff between said groups of pins.

4. The combination of claim 3, in which the instrument is made up of three detachable inter-connecting parts, an upper and lower part each having sound producing elements and a central part.

5. The combination of claim 1 in which the staff is branched, for example forked, to provide support for additional sound producing elements.

6. The combination of claim 1 in which the base of the staff is provided with a resilient pad or covering.

7. The combination of claim 1, in which the rod is cylindrical.

8. The combination of claim 7 in which, periodically along the length of the rod, teeth are recessed relative to the other teeth and to the surface of the rod.

9. The combination of claim 8 in which every third tooth is recessed.

10. In combination, (1) a musical percussion instrument comprising:

(a) a staff having a central portion, an upper end portion, and a lower end portion, (b) a plurality of pins extending radially from the upper end portion of said shaft, and (c) a plurality of cupped disc sound producing elements each having an aperture in the center thereof, and each said disc supported on a said radially extending pin, with the pin extending through the aperture of the disc, and (2) a toothed rod for drawing across said central portion of the staff, so that successive teeth on the rod impart successive impacts to the staff.

11. The combination of claim 10, wherein at least some of said pins are located one above the other in a common plane.

12. The combination of 10 or 11, wherein at least some of said pins lie in different radial planes passing through said staff.

13. The combination of claim 10, and further comprising a plurality of pins extending radially from the lower of said shaft, said last mentioned plurality of pins having a plurality of cupped disc sound producing elements supported thereon, said discs having apertures in the center thereof with the pins at the lower end of said staff extending through said apertures.

* * * * *